US006478626B2

(12) United States Patent
Dingenotto et al.

(10) Patent No.: US 6,478,626 B2
(45) Date of Patent: Nov. 12, 2002

(54) MULTIPOLE PLUG CONNECTOR FOR ELECTRONIC SIGNAL LINES

(75) Inventors: Meinolf Dingenotto, Schloss Holte; Jörg Kühle, Welver-Borgeln, both of (DE)

(73) Assignee: Filtec Filtertechnologie fuer Die Elektronikindustrie GmbH, Lippstadt (DE)

( * ) Notice: Subject to any disclaimer, the term of this patent is extended or adjusted under 35 U.S.C. 154(b) by 0 days.

(21) Appl. No.: 09/910,743

(22) Filed: Jul. 23, 2001

(65) Prior Publication Data

US 2002/0025719 A1 Feb. 28, 2002

(30) Foreign Application Priority Data

Aug. 26, 2000 (DE) ..... 200 14 791

(51) Int. Cl.[7] ..... H01R 13/66; H01R 33/945; H01H 7/00

(52) U.S. Cl. ..... 439/620; 333/181

(58) Field of Search ..... 439/620, 607, 439/333; 333/181, 166

(56) References Cited

U.S. PATENT DOCUMENTS 5,352,995 A 10/1994 Mouissie ..... 333/181
5,509,825 A * 4/1996 Reider et al. ..... 439/620
5,647,766 A * 7/1997 Nguyen ..... 439/103
5,827,092 A * 10/1998 Minich ..... 439/620
5,838,216 A * 11/1998 White et al. ..... 333/182
6,036,546 A * 3/2000 Dingenotto ..... 439/620

FOREIGN PATENT DOCUMENTS

DE 43 18 067 A1 1/1994

* cited by examiner

*Primary Examiner*—Brian Sircus
*Assistant Examiner*—Chandrika Prasad
(74) *Attorney, Agent, or Firm*—Laurence A. Greenberg; Werner H. STemer; Ralph E. Locher

(57) ABSTRACT

A plug connector having a housing and an insulating body in the housing is described. Contact inserts are provided and correspond to the total number of lines passing through, each with a connecting sleeve, insert foot, insert body and with sockets/pins, and at least one line is electrically connected via a matching circuit to the housing. The matching circuit is accommodated by the plug connector housing and is connected to the signal conductors and the housing ground. For this purpose, the connector receptacles are in the form of roughly cylindrical apertures with circumferential inner rings which, facing the filter chamber, have an axial groove, with a window toward the filter chamber. Each of the inserted contact inserts has a matching ring interacting with the inner ring and has a device to ensure that the contact insert is seated without any play, and that contact is made with the matching circuit.

12 Claims, 3 Drawing Sheets

MULTIPOLE PLUG CONNECTOR FOR ELECTRONIC SIGNAL LINES

BACKGROUND OF THE INVENTION

Field of the Invention

The invention relates to a multipole plug connector for holding a mating connector. The connector has an insulating body which is disposed in a housing and has a total number of contact inserts corresponding to the total number of lines passing through for signals, control currents, power currents or the like. The contact inserts are inserted into connector receptacles and each have a connecting sleeve, insert foot, insert body and a socket or pin for the connection of lines. A matching circuit is provided for at least one line, which matching circuit is essentially in the form of a planar insert, has at least one capacitor and is electrically connected to the associated line via a signal contact surface and to the housing via a ground contact surface.

Commercially available multipole plug connectors are used in conjunction with mating connectors as plug connectors for lines for digitized signals as well as for coaxial lines and/or power lines, by which electrical power can be supplied to the connected load. When such plug connections are used, for example, in computer or in telephone networks whose connecting lines carry digitized signals for data interchange, interference can occur as a consequence of radio-frequency signals which are picked up by the connecting lines. This effects pulse-type signals which are used for transmitting digital signals and whose higher harmonics can be subject to disturbances caused by interference, particularly when such pulses are produced in the area of a number of networked electronic data processing systems. Such disturbances can be kept within limits by the use of filters. Published, Non-Prosecuted German Patent Application DE 43 18 067 A1 describes such a plug connector.

SUMMARY OF THE INVENTION

It is accordingly an object of the invention to provide a multipole plug connector for electronic signal lines which overcomes the above-mentioned disadvantages of the prior art devices of this general type, such that the electronic components provided in the circuit are accommodated completely by the housing of the plug connector and can be connected to the signal conductors at one end and to the housing ground at the other end, and in which case the plug connector developed in this way can be produced easily and economically and can be used safely.

With the foregoing and other objects in view there is provided, in accordance with the invention, a multipole plug connector for holding a mating connector. The plug connector contains a housing and a plurality of contact inserts corresponding to a number of lines passing through for signals, control currents, and power currents. Each of the contact inserts has a connecting sleeve, an insert foot, an insert body, and a socket or a pin for connecting to a line. The insert body includes a matching ring. A matching circuit for at least one of the lines is provided and has a signal contact surface and a ground contact surface. The matching circuit is a planar insert having at least one capacitor and is electrically connected to an associated line through the signal contact surface and to the housing through the ground contact surface. An insulating body is disposed in the housing and has connector receptacles formed therein and a filter chamber formed therein. The connector receptacles have a substantially cylindrical aperture form with a circumferential inner ring which, facing the filter chamber, has an axially running groove formed therein located such that it opens a window toward the filter chamber. Each of the contact inserts is inserted into one of the connector receptacles and the matching ring of each of the contact inserts interacts with the circumferential inner ring. The contact inserts each have a first device for ensuring that the contact inserts are seated substantially without any play and a second device for ensuring that contact is made with the matching circuit.

The insulating body is substantially cuboid and has, at least on its longitudinal side, a filter chamber into which a planar matching circuit is inserted. Furthermore, the insulating body has substantially cylindrical connector receptacles, into which the contact inserts are inserted. In this case, a circumferential inner ring is provided in each of these connector receptacles, with the connector receptacles having a substantially cylindrical aperture. The inner ring is interrupted by an axially running groove in the sides facing the filter chamber, which groove passes through the wall facing the filter chamber and thus opens a window toward the filter chamber. Contact between the contact insert and the signal contact surface of the matching circuit is made through this window. Furthermore, each of the contact inserts which is inserted into one of the connector receptacles has a matching ring which interacts with the inner ring in the connector receptacles. The push fit of the matching ring in the circumferential inner ring (which is interrupted only by the axial grooves) fixes the contact insert radially. Finally, the contact insert is provided with a first device to ensure that the contact insert is also seated axially substantially without any play, and with a second device to ensure that contact is made with the matching circuit.

A circlip which is inserted into an annular groove in the contact insert and whose internal diameter is greater than the external diameter of the annular groove is provided as the first device for ensuring that the contact insert is seated substantially without any play, such that the circlip is elastically compressed, reducing the size of the circlip joint, and is held by the annular groove such that the circlip can be compressed by the inner ring of the insulating body. After being passed through, the elastic forces spread the circlip once again, enlarging its external diameter so that it engages behind the underneath of the inner ring so as to prevent the contact insert from being pulled out in the direction of the insert foot. The circlip is in this case configured such that pressure cannot be applied to it by the inner ring and, in fact, it remains lying against the inner ring. At the same time, the heights of the inner ring and of the matching ring are matched to one another such that, when the contact insert is inserted, its foot rests on the rest surface of the upper rest and with the interposition of a contact ring, the influence of the circlip pulls the foot against the rest. This thus also ensures that the contact insert is seated substantially without any play with regard to axial movement.

The contact ring is provided as the second device for ensuring that contact is made with the matching circuit, and is inserted between the circlip and the foot of the connector contact insert. The interposed contact ring surrounds the contact insert and makes electrical contact with it. It has two contact arms that are diametrically opposite one another, are aligned with their axes substantially parallel and pass, in a sprung manner, through the axial grooves and the windows opened by them. In this configuration, the free ends of the contact arms form the contact surfaces that rest in a sprung manner against the signal contact surfaces of the matching circuit and thus make the electrical contact. A pressure strip is advantageously provided which, interacting with the free ends of the contact arms, presses them against the signal contact surfaces. For this purpose, the filter chamber is bounded by a strip which is provided toward the contact insert, projects beyond the free end of the contact arms and whose end is chamfered in the form of a wedge toward the contact arms so that the free ends of the contact arms slide on these chamfers and are pressed against the signal contact surfaces.

The contact ring advantageously has a device for increasing the contact pressure, the device points toward the side of the foot of the contact insert so that the contact that is made is a linear or point contact. The device which increases the contact pressure is pulled against the insert foot under the influence of the forces originating from the circlip, with at least any oxide layers which may be present being broken through so that reliable electrical contact is ensured. Corrugations or tooth systems, for example, may be provided as such a device, at least two, and preferably three or four, contact claws are advantageously pushed out of the contact ring.

For connection of the conductor, the connecting end of the socket is in the form of a solder sleeve so that the conductor can be soldered in a known manner. If soldering needs to be avoided, for example for environmental protection reasons, the sleeve is in the form of a crimping sleeve. This allows the known soldering technique to be avoided; this is because the production of cables which are matched to particular applications and with plug connectors in which at least some of the conductors are electrically connected to a circuit can be carried out by crimping. The configuration allows the prefabricated contact inserts to be inserted into the plug connector housing even retrospectively; if the cable connections need to be soldered, this can be done before insertion, so that heat-sensitive components in the matching circuit are not thermally loaded.

The circuit with its electronic components is in the form of a planar filter insert that is in the form of a board, being configured as individual elements, twin or twisting elements, or as element rows. Capacitors are preferably provided as components, but inductances, resistors or voltage-limiting devices such as varistors or the like may also be provided. In this case, those components which cannot be produced by printing methods are placed, in a physically miniaturized form, onto the base, with a printed circuit board or a planar substrate being provided as the base for this purpose. For certain situations, discrete components in the form of chips are soldered onto the bases, the printed circuit board or the planar substrate so as to achieve a high level of flexibility.

The contact springs which interact with the connector are connected to the connecting contacts and make contact with the connections of the electronic components which are used for the circuit, such that the signal lines which are connected to the connector are passed through to the respectively associated electronic components in the circuit. The outputs from the electronic components provided for the circuit are connected to the housing, which is at ground potential. For this purpose, ground contact surfaces are provided at the rear, which are conductively connected to the metallic parts of the housing. If two or more rows of connector sockets/pins are provided, the rearward contact surfaces cannot be directly connected to the metallic parts of the housing. In order to achieve a conductive connection in this case as well, the ground contact surfaces are in this case routed out at the sides as contact areas, which are connected to the metal parts of the housing. In this way, electrical connectors can be produced which are connected as an input/output socket or as input/output connectors interacting with such sockets, with all the sockets/plugs, or individual sockets/plugs, being connected to electronic components. The described construction can also be used with a series inductance being provided in the course of the signal or power line. In conjunction with the latter, this even allows the construction of Π filters, with two drain capacitors being provided, one being connected upstream of the series inductance, and the other downstream of it.

The matching circuit is advantageously in the form of a parallel capacitor that can be connected to ground via the ground contact surface. Alternatively, the matching circuit has a series inductance that is located in the course of at least one of the lines. In various combinations, the matching circuit may furthermore have a parallel capacitor and a series impedance and be connected as a Π filter or, with a further series inductance, as a T-filter. In this case, other electronic components may also be provided, for example voltage-limiting varistors or the like.

Other features which are considered as characteristic for the invention are set forth in the appended claims.

Although the invention is illustrated and described herein as embodied in a multipole plug connector for electronic signal lines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
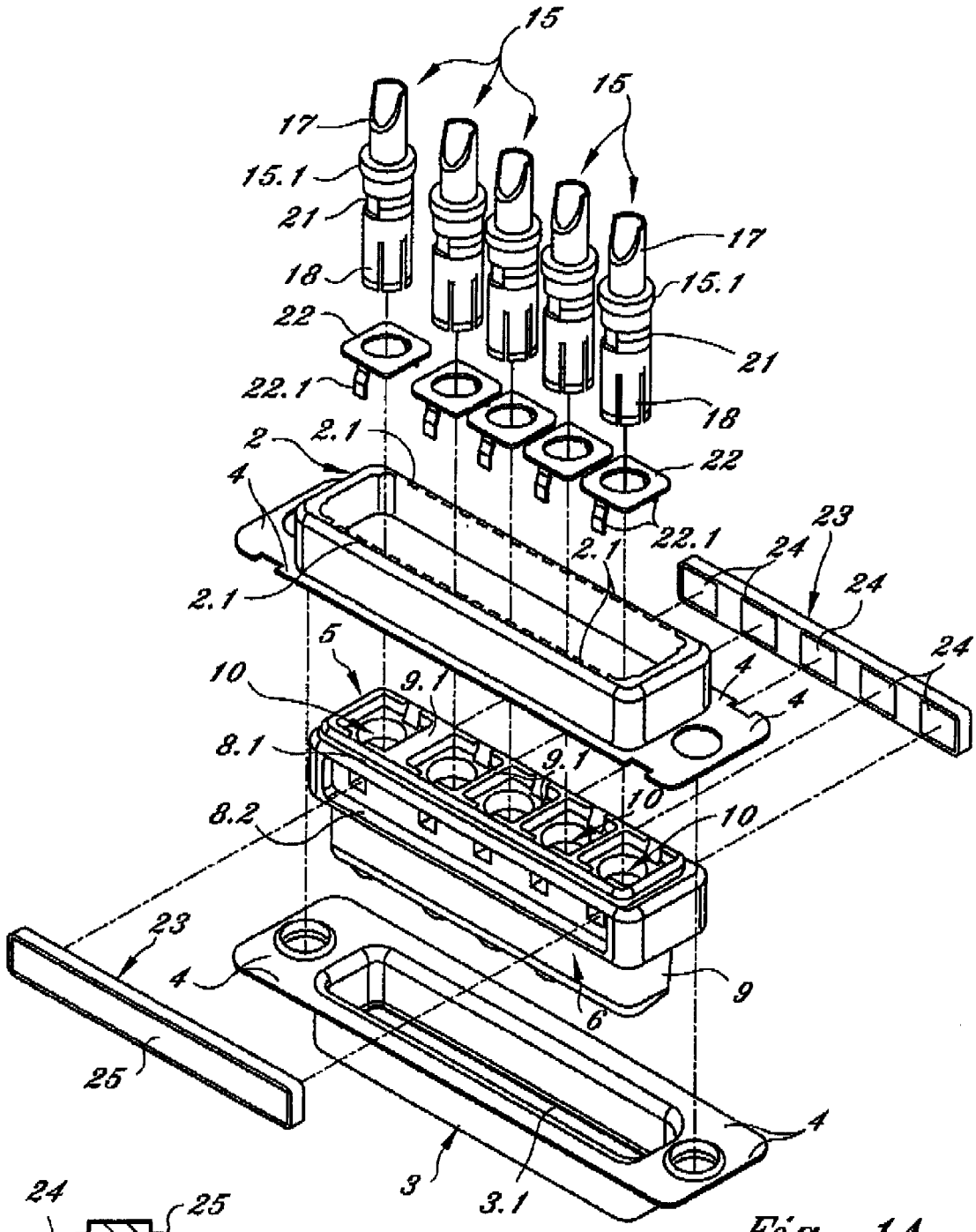
FIG. 1A is a diagrammatic, exploded perspective view of a plug connector having a row of connector sockets according to the invention.

In all the figures of the drawing, sub-features and integral parts that correspond to one another bear the same reference symbol in each case. Referring now to the figures of the drawing in detail and first, particularly, to FIG. 1A thereof, there is shown an overview of a multipole plug connector with five lines passing through, four of which are disposed immediately adjacent, and with the fifth being disposed at a distance from them. A housing, which is metallic for shielding reasons, contains an upper shell 2 and a lower shell 3 which can be joined together—corresponding to the dashed and dashed-dotted lines.

The edges, which are bent outward, of the two housings 2 and 3 form circumferential flanges 4 via which the two shells 2 and 3 are connected to one another, for example by welding, soldering or other connecting process. An insulating body 5 is disposed between the upper shell 2 and the lower shell 3 and is held between the two shells 2 and 3. Peened surrounds 2.1 and 3.1 in this case engage under the insulating body 5 in a region of longitudinal side walls 6 which have, corresponding thereto, indentations 6.1 and 6.2, respectively, at a lower and upper end, thus ensuring retention.

The insulating body 5 is in the form of a block with the longitudinal side walls 6 and with transverse side walls 9 at the ends, with partition walls 9.1 separating individual receptacles 10 for receiving contact inserts 15 from one another. For the receptacles 10, the insulating body 5 has in each case one connector receptacle 10 passing through it, into which the contact inserts 15 are inserted—in this case illustrated as inserts with connector sockets—although it is self-evident that connector pins can be inserted in the same way. At least on one side, the insulating body 5 has a filter chamber 7 into which a filter insert 23 is inserted. In this case, each of the filter inserts 23 has the same number of individual filters as there are line apertures to be filtered (in the case of the illustrated plug connector, all five lines are filtered).

Figure 1B:
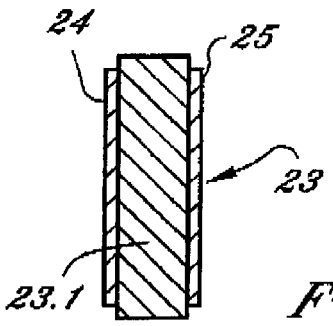
FIG. 1B is a sectional view of a filter insert.

The filters are disposed as filter capacitors in a dielectric body 23.1 of the filter insert 23, and their electrodes are passed out and make contact with external metal surfaces. FIG. 1B shows the filter insert 23 in cross section formed of the dielectric body 23.1, the signal contact 24 and the ground contact 25. In this case, the capacitor electrodes which are associated with the line to be filtered are connected as signal electrodes to signal contacts 24, and the opposite electrode is connected as a ground electrode to the metallic surface of a (common) ground contact 25, although other forms of making contact are also possible, for example if, owing to different potentials, no common contact may be provided on the ground side. In this case, circuits can be provided for all the signal or power lines or for individual signal or power lines, in which case capacitors, inductances or resistors can be provided for this purpose.

Figure 2A:
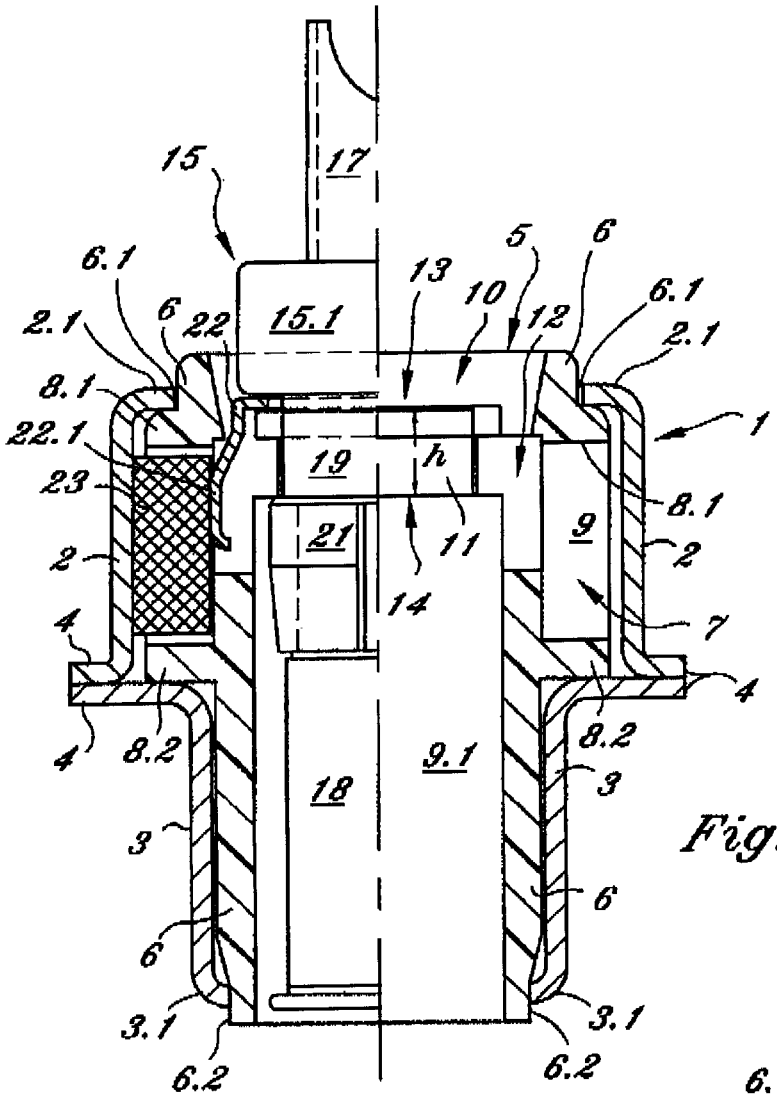
FIG. 2A is a sectional view of a plug connector housing with an inserted socket (section transversely to the longitudinal extent, split: on the right without, on the left with the filter insert)
Figure 2B:
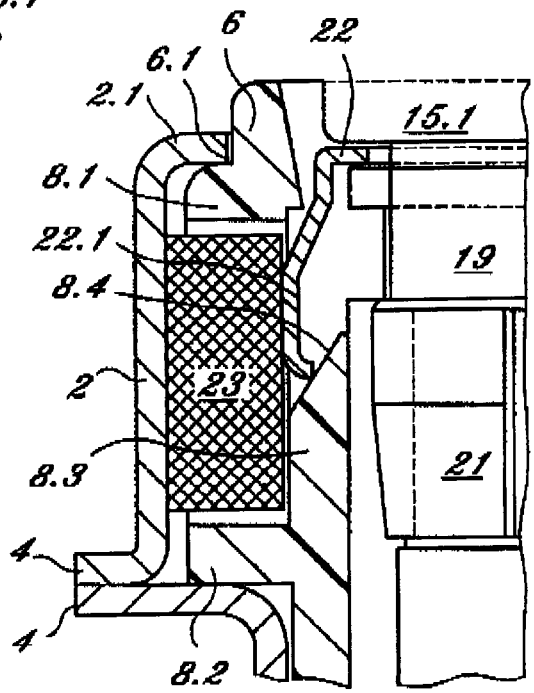
FIG. 2B is a detailed, sectional view of a contact arm/pressure strip.

FIG. 2A shows a cross section through a plug connector of one of the connector receptacles 10. In the illustration, the contact insert 15 is inserted in the left-hand half of the insulating body 5, while the right-hand half is illustrated empty (to assist identification, the filter insert 23 has also been omitted on the right). The side walls 6 are provided in an upper region with an upper strip 8.1 and a lower strip 8.2 between which the filter chamber 7 is formed, and the filter chamber is bounded, toward the contact insert 15, by a further strip 8.3 (FIG. 2B). The filter insert 23 is inserted into the filter chamber 7. In this case, a rear boundary wall of the filter chamber 7 forms a part of the transverse side wall 9, so that a contact insert passing all the way through can be inserted.

A curved partition wall 9.1 which is matched to the hole radius can be seen in the background, and this bounds the hole area (the transverse wall 9 at the end can also be provided instead of the partition wall 9.1). The partition wall 9.1 has a rest 13 which projects like a strip toward the interior of the cavity and has a circumferential ring 11 which projects toward the interior of the cavity and whose lower edge 14 forms an opposite bearing which, by interacting with the rest 13, ensures the seating of the inserted contact insert 15. Axial recesses 12 are provided toward the side walls and each open a window toward the filter chamber 7, thus forming grooves running parallel to the axis.

The contact insert 15 together with its connection (illustrated as a solder connection 17) and with a connector socket 18 (a connector pin may also appear at this point), is inserted into the insulating body 5 and its foot 15.1 is seated on the opposite rest 13, with a contact ring 22 being inserted between the rest 13 and the foot 15.1 of the contact insert 15. The foot 15.1 is followed by a matching ring 19 and an annular groove 20. The matching ring 19 interacts with the circumferential inner ring 11 and centers the inserted contact insert 15. The matching ring 19 is followed by the annular groove 20 into which a circlip 21 is inserted which presses through the opening of the circumferential inner ring 11, engages behind the latter and thus prevents the contact insert 15 from being pulled out. The contact ring 22 in this case rests on the upper rest 13 since a height "h" of the circumferential inner ring 11 together with the upper rest 13 is stepped at the level of the matching ring 19 and the contact ring 22 so that further pushing through is also prevented and a correspondingly secure seat is achieved, with the required contact pressure.

The contact ring 22 has contact arms 22.1, at least two of which are disposed diametrically opposite one another. The contact arms 22.1 run substantially parallel to the axis of the contact insert 15, and are bent outward in such a manner that they rest against the signal contact surfaces 24 of the circuit 23. In order to achieve reliable contact in this case as well, strips which bound the filter chamber 7 toward the contact insert 15 are routed as far as the free ends of the contact arms 22.1 where they each form a pressure strip 8.4 in the form of a wedge (FIG. 2B), on which the free ends of the contact arms 22.1 slide and against which the signal contact surfaces are pressed.

Figure 3A:
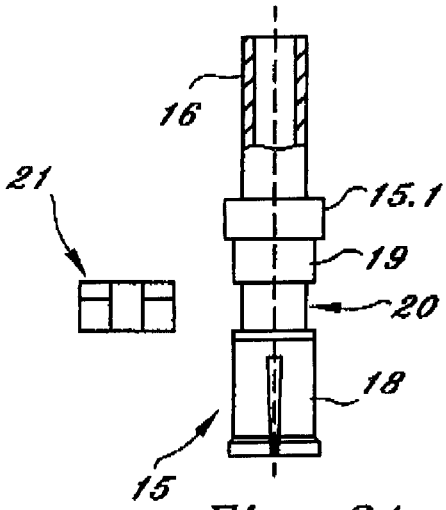
FIG. 3A is a front-elevational view of a plug connector insert and circlip.
Figure 3B:
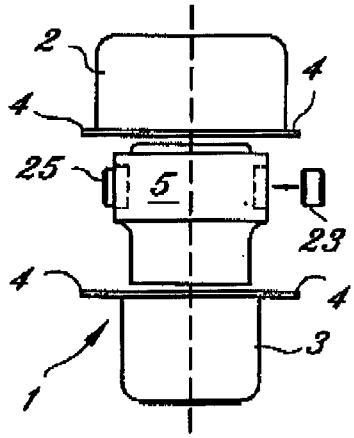
FIG. 3B is an exploded, front-elevational view of a housing for plug connector with insulating insert.
Figure 3C:
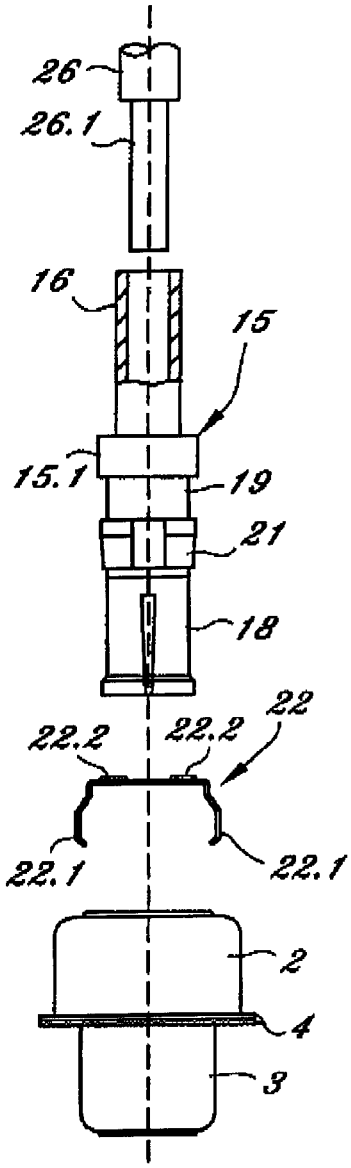
FIG. 3C is an exploded, front elevational view of the plug connector insert and connecting line, contact ring and housing.
Figure 3D:
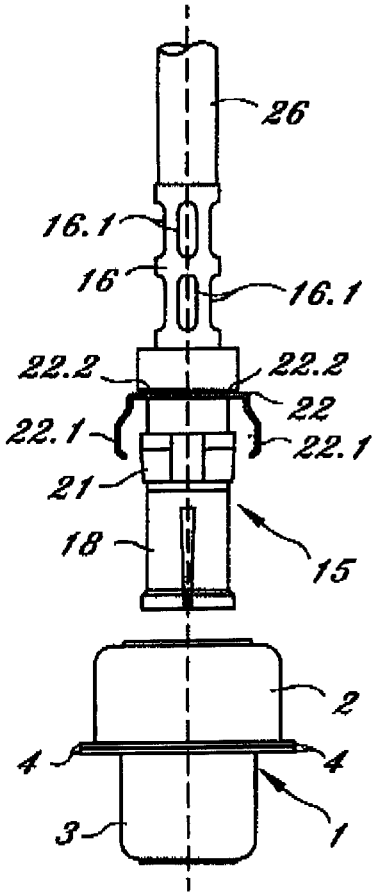
FIG. 3D is a front elevational view of the plug connector insert connected to a line to be inserted in the housing.
Figure 3E:
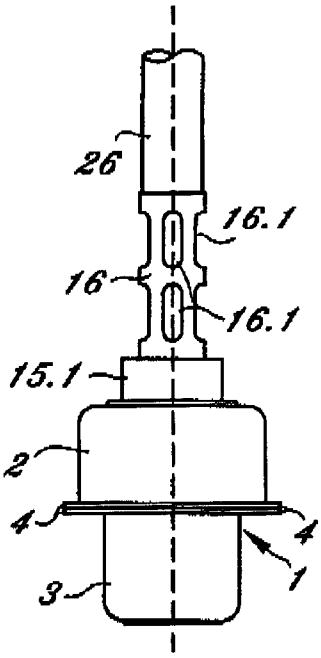
FIG. 3E is a front elevational view of the plug connector with the plug connector insert inserted into the housing.

FIGS. 3A–3E show a sequence of steps relating to the production of such a plug connector insert. In FIG. 3A the circlip 21 has been placed on the contact insert 15, which is held by the annular groove 20 with a certain amount of play. FIG. 3B shows the housing being joined together, into which the insulating body 5 is inserted. The next step, shown in FIG. 3C is for the connector contact insert 15, completed with the circlip 21, to be connected to a conductor 26. This is done by crimping, for which purpose a stripped conductor end 26.1 is inserted into a crimping sleeve 16 where it is crimped in a known manner, thus forming the crimping marks 16.1. FIG. 3D shows the insertion of the connector contact insert 15 that has been prepared in this way into the housing 1 (completed as shown in FIG. 3B). The insertion process is carried out with the conductor 26 connected. Pressure is exerted to push the connector contact insert 15 into the insulating body 5. In the process, owing to the play in its seat, the circlip 21 is compressed and slides through the circumferential inner ring 11; after being pushed in further, the circlip 21 can expand again behind the opposite bearing 14, and can engage behind the latter. In the process, the foot 15.1 of the contact insert 15 rests, with the interposed contact ring 22, on the upper rest 13, ensuring matching of the heights of the circumferential inner ring 11 with the upper rest 13 and the matching ring 19 ensuring seating (virtually) without any play. In order to achieve an adequate contact pressure, devices are provided which rest virtually in the form of points or lines, or a point or line, against the underneath of the foot 15.1 of the contact insert 15. In the illustration, the devices are shown as obliquely positioned contact claws 22.2 which, can flex and penetrate through any oxide layers which may be present, while being joined to the metal of the foot 15.1 of the contact insert 15. The force required to do this is provided by the expanding circlip 21 which is advantageously positioned at a suitable angle for this purpose with respect to the lower edge of the circumferential inner ring 11. This configuration results in the contact pressure required for reliable contact, while at the same time also preventing the contact insert 15 from being pushed through any further.

We claim:

1. A multipole plug connector for holding a mating connector, comprising:

a housing;

a plurality of contact inserts corresponding to a number of lines passing through for signals, control currents, and power currents, each of said contact inserts having a connecting sleeve, an insert foot, an insert body, and one of a socket and a pin for connecting to a line, said insert body including a matching ring;

a matching circuit for at least one of the lines and having a signal contact surface and a ground contact surface, said matching circuit being a planar insert having at least one capacitor and is electrically connected to an associated line through said signal contact surface and to said housing through said ground contact surface; and an insulating body disposed in said housing and having connector receptacles formed therein and a filter chamber formed therein, said connector receptacles have a substantially cylindrical aperture form with a circumferential inner ring which, facing said filter chamber, has an axially running groove formed therein located such that it opens a window toward said filter chamber, and each of said contact inserts inserted into one of said connector receptacles and said matching ring of each of said contact inserts interacting with said circumferential inner ring, said contact inserts each having a first device for ensuring that said contact inserts are seated substantially without any play and a second device for ensuring that contact is made with said matching circuit.

2. The multipole plug connector according to claim 1, wherein each of said contact inserts has a annular groove formed therein and said first device for ensuring that said contact inserts are seated substantially without any play is a circlip disposed in said annular groove and fixes a respective contact insert of said contact inserts in a respective one of said connector receptacles, said matching ring has a given height matching a height of said circumferential inner ring such that, when said respective contact insert is inserted, said insert foot rests on a surface of said circumferential inner ring which forms an upper rest, and including a contact ring disposed between said insert foot and said circumferential inner ring, and, said circlip engaging behind said matching ring ensures that said respective contact insert is seated substantially without any play.

3. The multipole plug connector according to claim 2, wherein said circlip has an internal diameter and said annular groove has an external diameter less than said internal diameter of said circlip, said circlip has a slot formed therein with a width set so that said circlip can be compressed to said external diameter of said annular groove.

4. The multipole plug connector according to claim 2, wherein said second device for ensuring that contact is made is said contact ring inserted, at least partially surrounding said contact insert, between said insert foot and said circlip, said contact ring has at least one contact spring arm passing through said axially running groove to said filter chamber and makes contact with said signal contact surface of said matching circuit.

5. The multipole plug connector according to claim 4, wherein said contact ring has two contact spring arms disposed diametrically opposite one another.

6. The multipole plug connector according to claim 5, wherein said insulating body has a strip bounding said filter chamber and extending along sides of said contact inserts beyond bent free ends of said contact spring arms and, in a region of said contact spring arms said strip has a chamfer formed thereon in a form of a wedge pointing toward said contact arms, said chamfer being a pressure strip and interacting with said bent free ends of said contact arms, presses said contact arms against said signal contact surfaces of said matching circuit.

7. The multipole plug connector according to claim 6, wherein said contact ring has a device for increasing a contact pressure.

8. The multipole plug connector according to claim 7, wherein said device for increasing the contact pressure is selected from the group consisting of corrugations and teeth projecting out of a plane of said contact ring on a side facing said insert foot of said contact insert.

9. The multipole plug connector according to claim 7, wherein said device for increasing the contact pressure are pushed-through contact claws formed on a surface of said contact ring.

10. The multipole plug connector according to claim 1, wherein said connecting sleeve is provided for connecting the line to said contact insert and said connecting sleeve is a solder sleeve.

11. The multipole plug connector according to claim 1, wherein said connecting sleeve is provided for connecting a line to said contact insert and said connecting sleeve is a crimping sleeve.

12. The multipole plug connector according to claim 1, wherein said matching circuit is a filter having a parallel capacitor connected to ground through said ground contact surface.

* * * * *